US008371549B1

(12) United States Patent
Paquette

(10) Patent No.: US 8,371,549 B1
(45) Date of Patent: Feb. 12, 2013

(54) HOLD FOR A TOOTHPASTE TUBE AND TOOTHBRUSHES

(76) Inventor: Brian T. Paquette, Brampton (CA)

( * ) Notice: Subject to any disclaimer, the term of this patent is extended or adjusted under 35 U.S.C. 154(b) by 297 days.

(21) Appl. No.: 12/806,331

(22) Filed: Aug. 10, 2010

(51) Int. Cl.
*A47K 1/08* (2006.01)
*B65D 35/24* (2006.01)

(52) U.S. Cl. ..... 248/312; 248/111; 222/93; 222/103; 222/105; 211/66

(58) Field of Classification Search ..... 248/311.2, 248/312, 311.3, 309.1, 108–110, 111, 310, 248/316.1, 346.03, 346.06, 349.1; 222/93–97, 222/101, 103, 105, 100, 104; 211/65–66, 211/113, 115; 206/361, 362.1, 362.2
See application file for complete search history.

(56) References Cited

U.S. PATENT DOCUMENTS 2,679,951 A * 6/1954 Yantzer ..... 222/101
2,709,025 A * 5/1955 Thomas ..... 222/341
3,155,278 A 11/1964 Le Baron
3,241,721 A * 3/1966 Freeman ..... 222/93
3,946,877 A 3/1976 Galicia
3,998,234 A 12/1976 Stubbmann
4,220,260 A * 9/1980 Webster ..... 222/100
4,359,173 A * 11/1982 Williams ..... 222/100
5,499,742 A * 3/1996 Ives, Sr. ..... 222/101
5,566,842 A 10/1996 Dennis
5,638,840 A 6/1997 Lee et al.
5,676,279 A 10/1997 Bastion
5,868,282 A 2/1999 Imhoff
6,364,165 B2 4/2002 Sampson et al.
6,595,376 B1 * 7/2003 Lin ..... 211/70.6
6,789,703 B2 9/2004 Pierre-Louis
2007/0158518 A1 * 7/2007 Kurdoghlian ..... 248/312

* cited by examiner

*Primary Examiner* — Tan Le
(74) *Attorney, Agent, or Firm* — Richard L. Miller

(57) ABSTRACT

A holder for a toothpaste tube and toothbrushes which comprises a mounting plate. A mechanism is for securing the mounting plate to a wall. A support member is provided. A mechanism is for rotatably maintaining the support member perpendicular to the mounting plate. A mechanism is for attaching the toothpaste tube perpendicular to the support member. A mechanism is for retaining at least one of the toothbrushes to the mounting plate.

7 Claims, 6 Drawing Sheets

HOLD FOR A TOOTHPASTE TUBE AND TOOTHBRUSHES

BACKGROUND OF THE INVENTION

1. Field of the Invention

The present invention relates to oral hygiene, and more particularly, a holder for a toothpaste tube and toothbrushes.

2. Description of the Prior Art

Numerous innovations for toothpaste and toothbrush holders and dispensers have been provided in the prior art that will be described. Even though these innovations may be suitable for the specific individual purposes to which they address, however, they differ from the present invention.

A FIRST EXAMPLE, U.S. Pat. No. 3,155,278, Issued on Nov. 3, 1964, to Le Baron teaches a toothpaste dispenser and brush holder comprising a generally U-shaped housing including a pair of generally parallel upstanding legs interconnected at one pair of adjacent sides by means of an upright bight portion, the holder including means adapted to support said housing from an upright supporting surface with the bight portion disposed in surface-to-surface contacting relation with the surface and three free ends of the legs projecting away from the surface, an upwardly opening U-shaped spring clip secured to the lower portion of the bight portion, an upright panel member disposed between the legs and having its lower edge removably retained in the clip with the latter pivotally securing the lower end of the panel member to the housing for rotation about an axis extending between the lower ends of the legs and generally paralleling the lower edge of the panel member with the free upper end of the panel member swingable toward and away from the upper end of the bight portion, an upwardly opening toothbrush receiving member carried by the side of the panel member remote from the bight portion and spaced inwardly from the upstanding side edge portions of the panel member, the free upstanding edges of the legs, remote from the panel member terminating in inturned flanges between which the toothbrush receiving member is receivable, the flanges defining abutments engageable by the opposite upstanding marginal edge portions of the panel member projecting outwardly beyond the toothbrush receiving member for limiting swinging movement of the upper end of the panel member away from the bight portion to a position defining an upwardly opening wedge shaped recess for the reception of an upright collapsible tube of toothpaste whereby the panel member may have its upper end pushed toward the bight portion in order to squeeze the collapsible tube and force toothpaste therefrom.

A SECOND EXAMPLE, U.S. Pat. No. 3,946,877, Issued on Mar. 30, 1976, to Galicia teaches a multi-clip plastic holder for toothbrushes, razors and other like articles has a base strip coated with a pressure-sensitive adhesive on its back side permitting the strip to be applied securely to any clean, firm surface whether flat or round. Integral with the base strip at spaced intervals therealong is a plurality of sets of coacting clip fingers each with outwardly-flared tips and suitably larger spacing midway therebetween to permit the handle of a toothbrush to be pressed therebetween from the outer end and to grip the handle and hold the same releasably in place. Each set of clip fingers is integral with the base strip over a sufficiently narrow length thereof to retain a flexibility for even adhesive application of the base strip to uneven surfaces without affecting the grip of the coacting clip fingers. In an alternative embodiment, the base strip has also clip members at the ends receiving cores to which a protective liner for the pressure-sensitive coating is attached. One of these cores is enlarged to serve as a spool which when pulled from one clip can be rolled along the back side of the base member to wind up the liner and to be then snapped into the second clip at the other end. When the holder is detached from a wall and is to be packed with other belongings for a later use, the spool is pulled from the second clip, rolled along the back side of the base strip to reapply the protective liner and is then snapped back into the first clip.

A THIRD EXAMPLE, U.S. Pat. No. 3,988,234, Issued on Dec. 21, 1976, to Stubbmann teaches a housing with a shallow recess having an animatable display positioned therein protected by a transparent shield. The animatable display includes a stationary fanciful representation of a character prominently displaying its teeth and movable representations of an arm and a hand carrying a replica of a toothbrush with its bristles adjacent the prominently displayed teeth. The character is standing in front of a sink on the stationary display. The movable representations of the animatable display are in operable communication with a spring driven musical movement within the housing and will be reciprocally translated in a generally vertical direction while the musical movement is playing. The musical movement is controlled by a blocking arm having a portion extending from the housing to form a control tab. The blocking arm is movable between two positions. In one position the blocking arm will prevent the activation of the musical movement and in the other position will permit the musical movement to play. The housing also has a holder for supporting at least one toothbrush. A timer may be provided which is responsive to the starts and stops of the musical movement to indicate the length of time that the child has brushed his or her teeth.

A FOURTH EXAMPLE, U.S. Pat. No. 5,566,842, Issued on Oct. 22, 1996, to Dennis teaches a holder for holding a toothpaste pump dispenser and toothbrushes. The holder has a base which is mounted to a vertical wall. A cup is coupled to the base so as to extend out from the wall. The cup receives and holds a toothpaste dispenser therein. The cup has an upper edge which permits a dispenser nozzle of the toothpaste dispenser to be operated so that toothpaste may be dispensed from the nozzle while the dispenser is located in the cup. Toothbrush mounts are also coupled to the base extending away from the wall. The toothbrush mounts receive and support toothbrushes on the holder.

A FIFTH EXAMPLE, U.S. Pat. No. 5,638,840, Issued on Jun. 17, 1997, to Lee et al. teaches a combination toothbrush holder, floss dispenser, drinking cup and toothpaste holder designed to compactly hold and dispense the above items while maintaining a unified appearance in the shape of a sitting cat. The head portion contains a standard dental floss container. The floss protrudes through a hole in the cat shaped head. A cutting blade is affixed to the top of the cat shaped head for cutting the floss. The mid section of the cat shape forms a drinking cup and also forms an enclosure for a standard toothpaste tube. The base section of the cat shape contains a pair of mating rollers capable of squeezing a tube of toothpaste captured between the two rollers. This happens when the user rotates the tail portion of the cat shape which is rigidly connected to the shaft of one of the rollers. The outside portion of the base contains receptacles for a plurality of toothbrushes. In this way, the present invention holds and dispenses all the items necessary for caring for the teeth and gums and does so in a compact and novel fashion which will entice the user the use the dental care items contained therein.

A SIXTH EXAMPLE, U.S. Pat. No. 5,676,279, Issued on Oct. 14, 1997, to Bastion teaches a new Gravity Powered Toothpaste Dispensing System for dispensing of toothpaste with one action control without utilization of an additional power source and preventing unsanitary leakage from open toothpaste containers. The inventive device includes a housing structure, a toothpaste dispensing front cover attached to the housing structure, at least one roller member slidably positioned within the housing structure and descending upon a toothpaste tube for facilitating dispensing of toothpaste, and a toothpaste lever and cap.

A SEVENTH EXAMPLE, U.S. Pat. No. 5,868,282, Issued on Feb. 9, 1999, to Imhoff teaches a dispenser for a material contained within a flexible tube which includes a main body that has a longitudinally extending front surface for supporting the tube, an opposing rear surface, a pair of side walls that extend upwardly from the front surface and along the longitudinal extent thereof, and a gear rack extending adjacent to an inner surface of each of the side walls. Preferably, the side walls are spaced apart a sufficient distance to receive the tube and the gear racks therebetween. An elongate roller has a shaft that extends from each end of the roller and each shaft projects through a slot and one of the side walls. Each shaft further includes a gear positioned between the roller and one of the side walls and in alignment with one of the gear racks. Each gear is in meshing engagement with its corresponding gear rack. A knob is attached to an outer end of at least one shaft for rotating the roller and gears with respect to the gear racks for moving the roller along the longitudinal extent of the front surface. The roller is spaced a sufficient distance from the front surface of the main body to thereby press the tube between the roller and the front surface and to force the material in the tube toward the tube spout. A toothbrush holder is mounted to and extends rearwardly from the main body rear surface. A wall mount is attached to a recess located in a rear surface of the toothbrush holder for mounting the dispenser to a wall. A portion of the adaptor base is received in the mounting recess when positioning the dispenser on a horizontal surface.

AN EIGHTH EXAMPLE, U.S. Pat. No. 6,364,165, Issued on Apr. 2, 2002, to Sampson et al. teaches a system for selectively dispensing toothpaste from a flexible toothpaste tube that includes a flexible boot having a flexible tube-receiving cavity and a boot nozzle with which an outlet of the toothpaste tube aligns. Pins are insertable into sleeves of the flexible boot and movable between open and closed positions for removal and insertion of the toothpaste tube. A presser engages the outer surface of the boot to selectively squeeze toothpaste from the toothpaste tube through the boot nozzle. A controller intermittently activates a driver which moves the presser along a track towards the boot nozzle to dispense a measured amount of toothpaste. Jaws are positioned adjacent to the boot nozzle for selectively opening and closing the boot nozzle. A timer and an adjustable volume dispensing dial control the amount of toothpaste dispensed.

A NINTH EXAMPLE, U.S. Pat. No. 6,789,703, Issued on Sep. 14, 2004, to Pierre-Louis teaches a toothpaste dispenser which holds a collapsible tube of toothpaste within a housing between a roller assembly and a wall surface. A plunger is operable from a relaxed, raised position to a lowered, depressed position to drivingly engage the roller assembly so that one or more rollers are moved along the toothpaste tube in a manner which squeezes toothpaste out of the tube and onto the bristles of a toothbrush held in close proximity to a dispensing outlet of the tube or a nozzle. A spring returns the plunger to the relaxed, raised position upon removing the downward force. The housing is provided with toothbrush holders and a removable cover to permit replacement of the tube of toothpaste.

It is apparent now that numerous innovations for toothpaste and toothbrush holders and dispensers have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a holder for a toothpaste tube and toothbrushes that avoids the disadvantages of the prior art.

ANOTHER OBJECT of the present invention is to provide a holder for a toothpaste tube and toothbrushes that is simple and inexpensive to manufacture.

STILL ANOTHER OBJECT of the present invention is to provide a holder for a toothpaste tube and toothbrushes that is simple to use.

BRIEFLY STATED, STILL YET ANOTHER OBJECT of the present invention is to provide a holder for a toothpaste tube and toothbrushes which comprises a mounting plate. A mechanism is for securing the mounting plate to a wall. A support member is provided. A mechanism is for rotatably maintaining the support member perpendicular to the mounting plate. A mechanism is for attaching the toothpaste tube perpendicular to the support member. A mechanism is for retaining at least one of the toothbrushes to the mounting plate.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALING OF REFERENCE NUMERALS UTILIZED IN THE DRAWING

Figure 1:
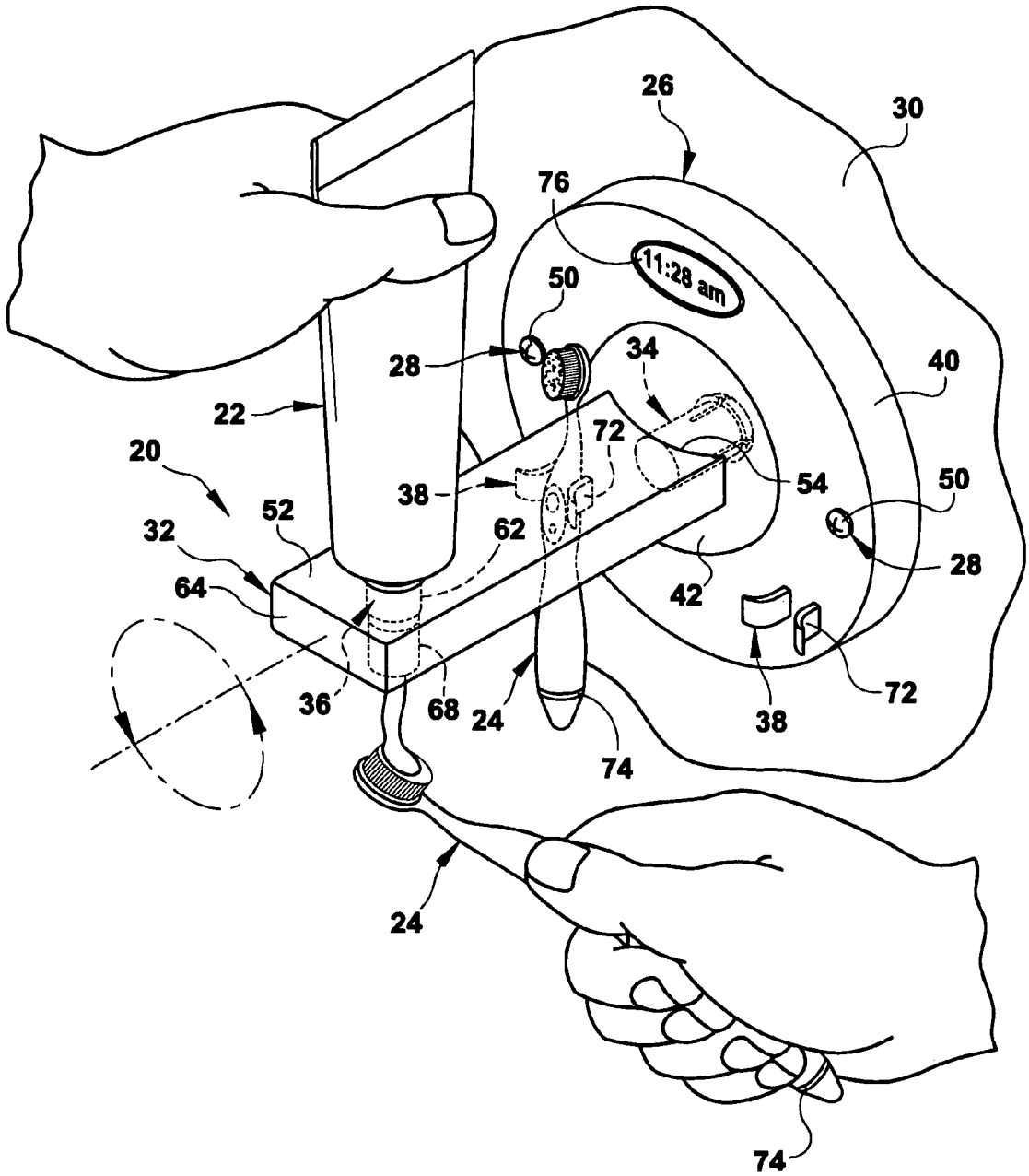
FIG. 1 is a diagrammatic perspective view of an embodiment of the present invention in use.

| | |
|---|---|
| 20 | holder |
| 22 | toothpaste tube |
| 24 | toothbrush |
| 26 | mounting plate of holder 20 |
| 28 | securing mechanism of holder 20 |
| 30 | wall |
| 32 | support member of holder 20 |
| 34 | rotatably maintaining mechanism of holder 20 |
| 36 | attaching mechanism of holder 20 |
| 38 | retaining mechanism of holder 20 |
| 40 | circular base of mounting plate 26 |
| 42 | dome portion of mounting plate 26 |
| 44 | central aperture in dome portion 42 |
| 46 | inner annular groove in central aperture 44 |
| 48 | hole in circular base 40 |
| 50 | mounting screw of securing mechanism 28 |
| 52 | rectangular bar of support member 32 |
| 54 | curved inner end of rectangular bar 52 |
| 56 | shaft of rotatably maintaining mechanism 34 |
| 58 | split end of shaft 56 |
| 60 | beveled ring on split end 58 |
| 62 | internally threaded bore of attaching mechanism 36 |
| 64 | outer end of rectangular bar 52 |
| 66 | externally threaded neck of toothpaste tube 22 |
| 68 | externally threaded collar on rectangular bar 52 |
| 70 | cap of toothpaste tube 22 |
| 71 | snap cap of toothpaste tube 22 |
| 72 | spring clip for retaining mechanism 38 |
| 74 | handle of toothbrush 24 |
| 76 | digital clock of holder 20 |

DETAILED DESCRIPTION OF THE PREFERRED EMBODIMENT

Figure 2:
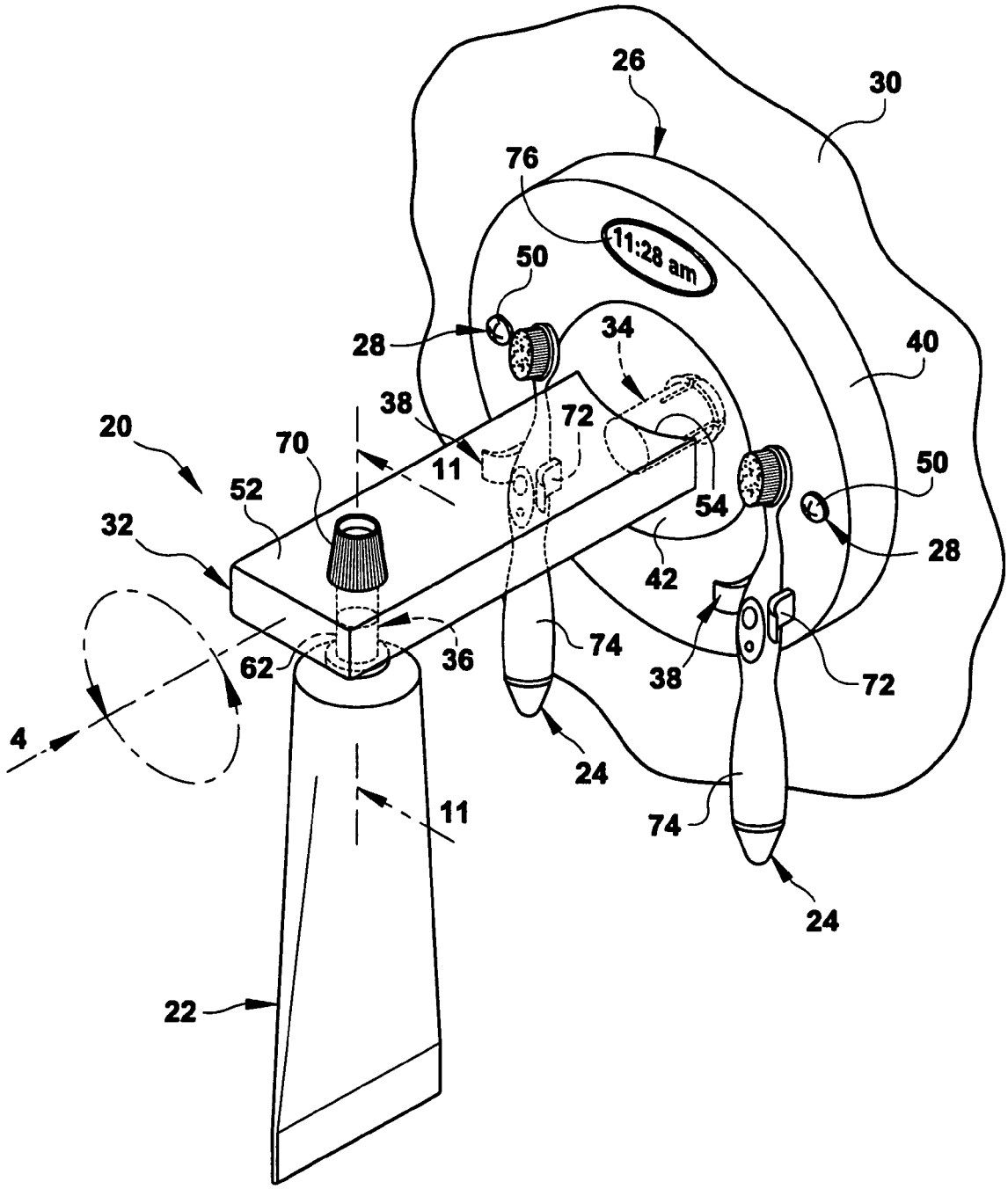
FIG. 2 is a diagrammatic perspective view of the present invention holding the toothpaste tube and toothbrushes thereto.
Figure 3:
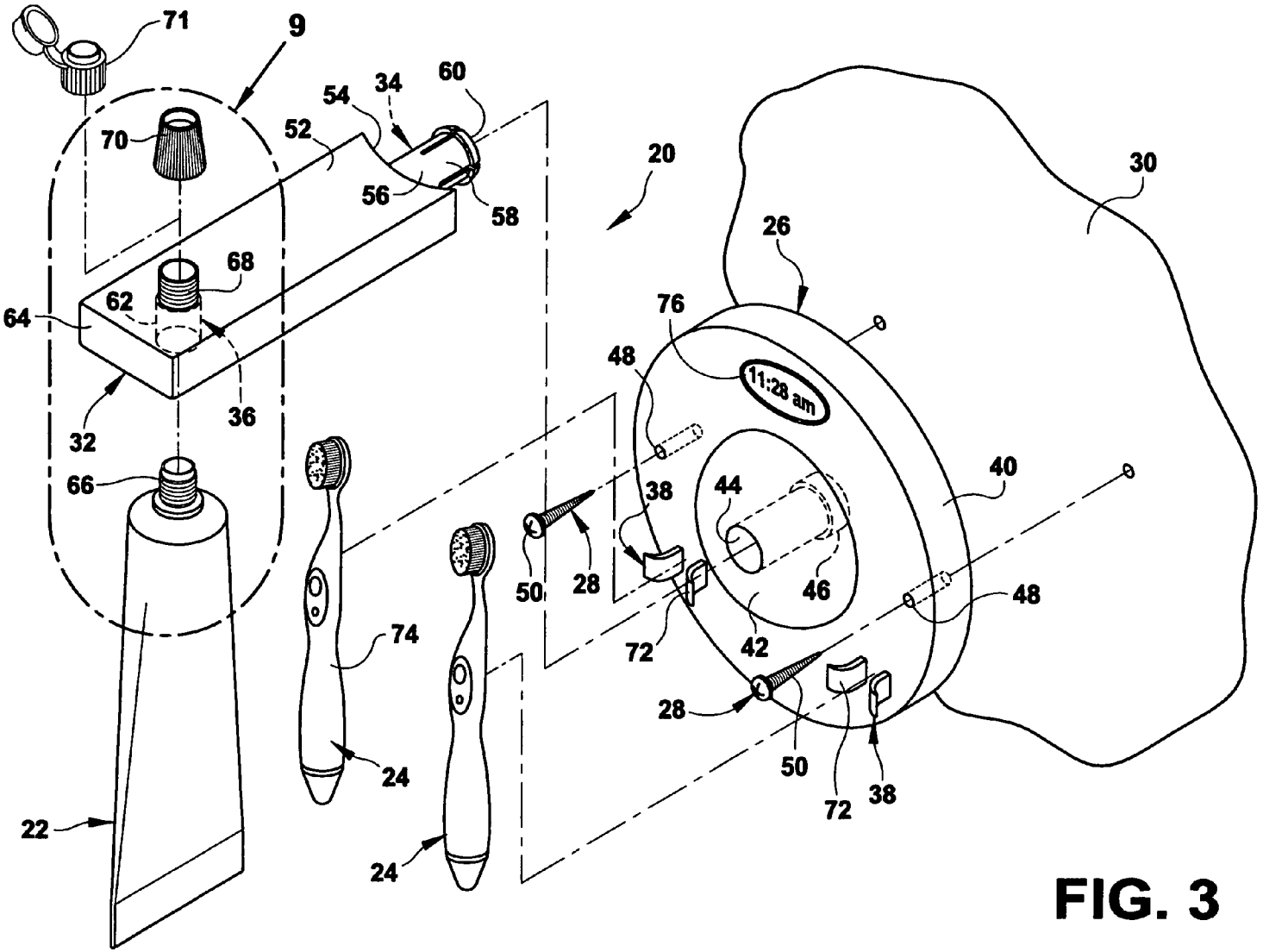
FIG. 3 is a diagrammatic exploded perspective view thereof.
Figure 5:
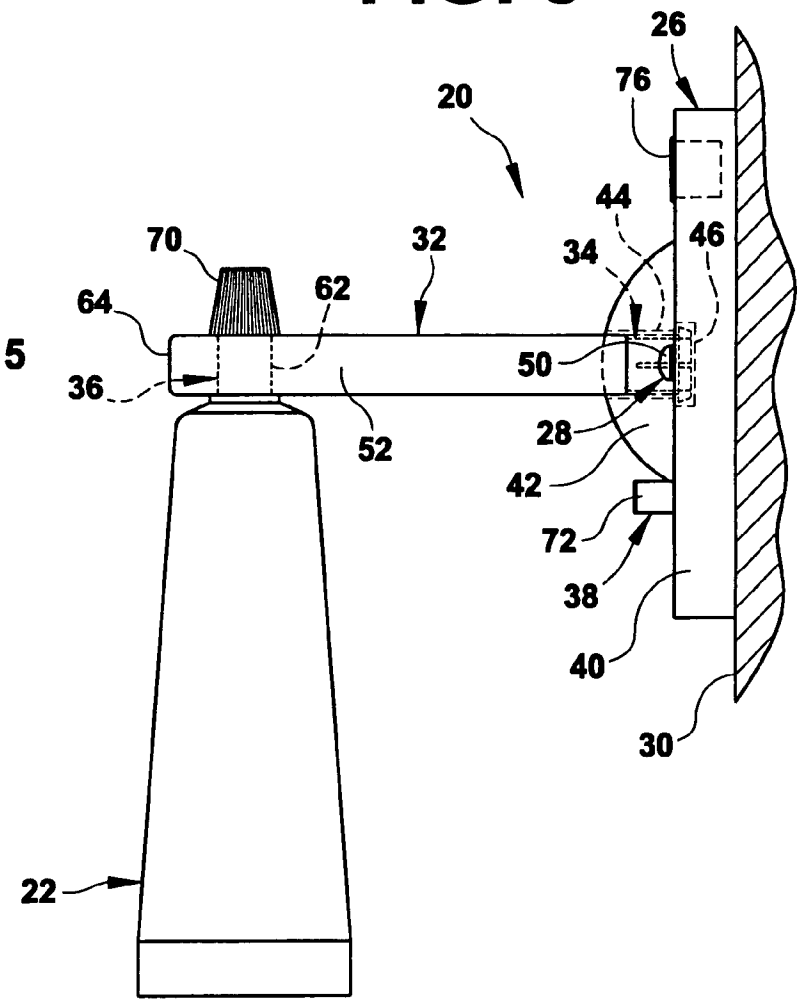
FIG. 5 is a diagrammatic side view taken in the direction of arrow 5 in FIG. 4.
Figure 4:
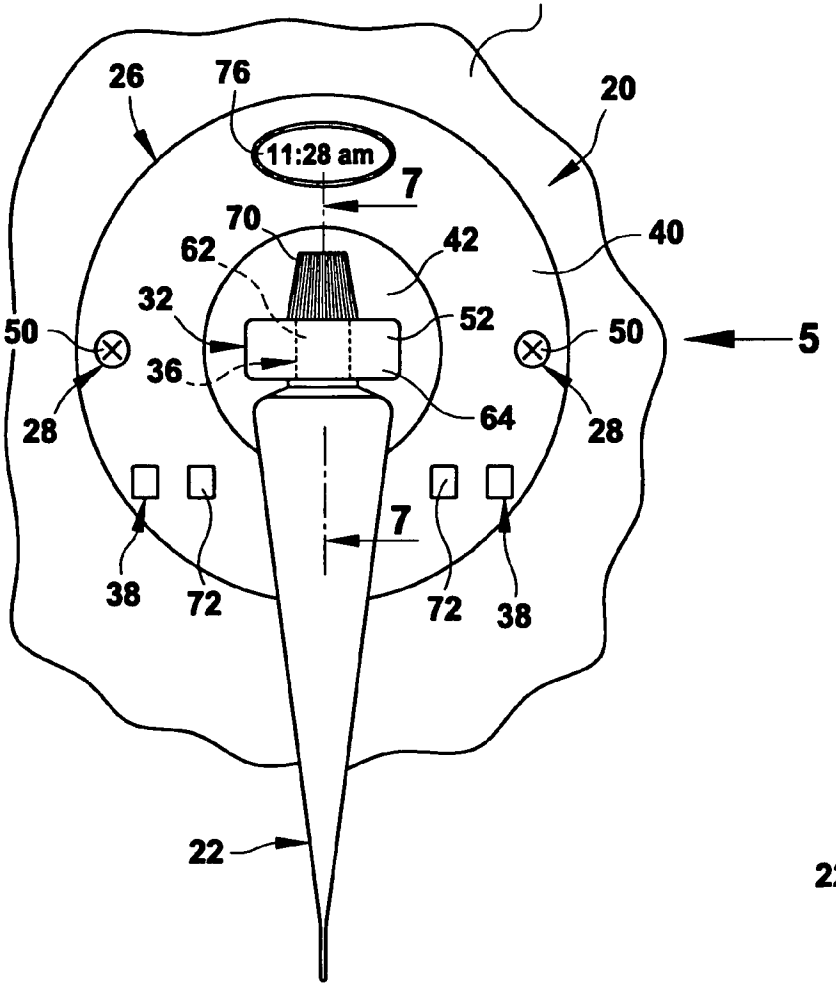
FIG. 4 is a diagrammatic front view taken in the direction of arrow 4 in FIG. 2, with the toothbrushes omitted.
Figure 6:
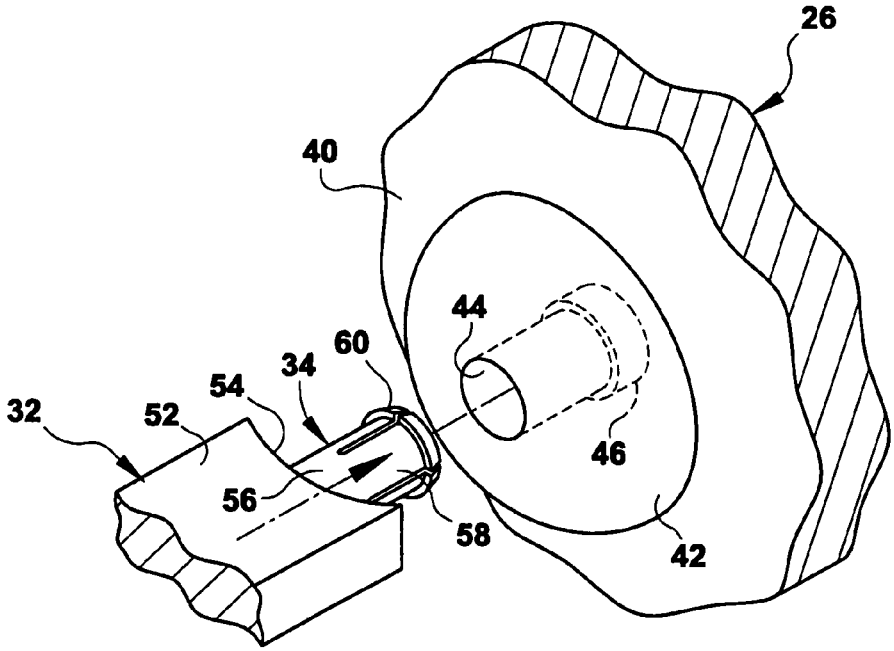
FIG. 6 is a diagrammatic exploded perspective view, with parts broken away, showing the shaft on the rectangular bar of the support member ready to be inserted into the aperture in the circular base of the mounting plate.
Figure 7:
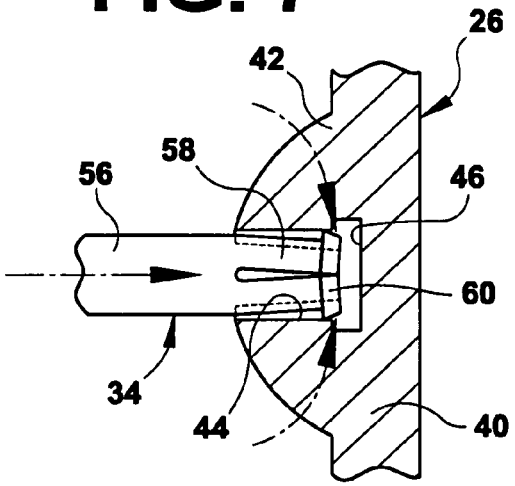
FIG. 7 is a diagrammatic cross sectional view taken on line 7-7 in FIG. 4, with parts broken away, showing the shaft being inserted within the aperture.
Figure 8:
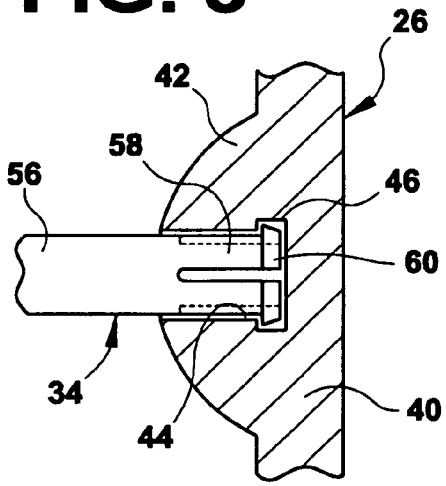
FIG. 8 is a diagrammatic cross sectional view, similar to FIG. 7, showing the shaft fully inserted within the aperture.
Figure 9:
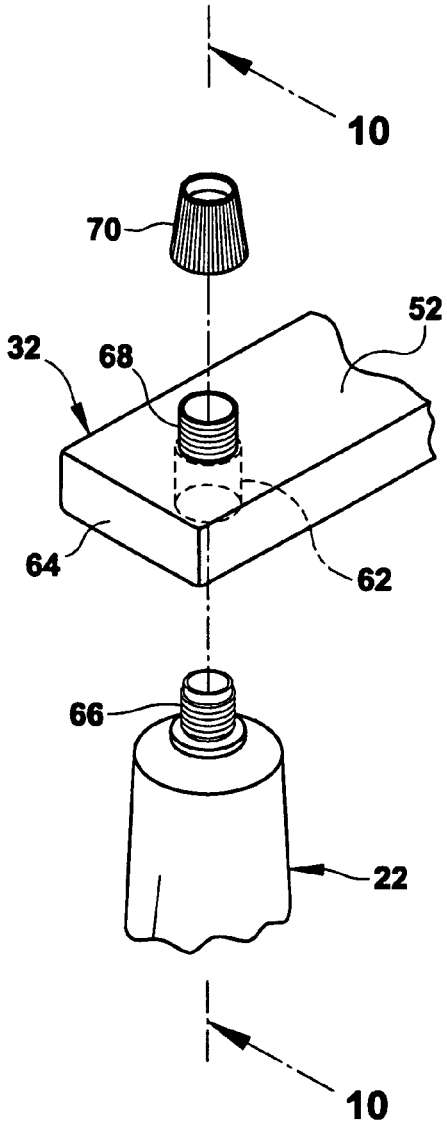
FIG. 9 is a diagrammatic exploded perspective view of the oval dotted area indicated by arrow 9 in FIG. 3.

Referring now to the figures, in which like numerals indicate like parts, and particularly to FIGS. 1 through 11, which are a diagrammatic perspective view of an embodiment of the present invention in use; a diagrammatic perspective view of the present invention holding the toothpaste tube and toothbrushes thereto; a diagrammatic exploded perspective view thereof; a diagrammatic front view taken in the direction of arrow 4 in FIG. 2, with the toothbrushes omitted; a diagrammatic side view taken in the direction of arrow 5 in FIG. 4; a diagrammatic exploded perspective view, with parts broken away, showing the shaft on the rectangular bar of the support member ready to be inserted into the aperture in the circular base of the mounting plate; a diagrammatic cross sectional view taken on line 7-7 in FIG. 4, with parts broken away, showing the shaft being inserted within the aperture; a diagrammatic cross sectional view, similar to FIG. 7, showing the shaft fully inserted within the aperture; a diagrammatic exploded perspective view of the oval dotted area indicated by arrow 9 in FIG. 3; a diagrammatic exploded cross sectional view taken along line 10-10 in FIG. 9; and a diagrammatic cross sectional view taken along line 11-11 in FIG. 2, showing the toothpaste tube secured to the support member, and as such, will be discussed with reference thereto.

The present invention is a holder 20 for a toothpaste tube 22 and toothbrushes 24 which comprises a mounting plate 26. A mechanism 28 is for securing the mounting plate 26 to a wall 30. A support member 32 is provided. A mechanism 34 is for rotatably maintaining the support member 32 perpendicular to the mounting plate 26. A mechanism 36 is for attaching the toothpaste tube 22 perpendicular to the support member 32. A mechanism 38 is for retaining at least one of the toothbrushes 34 to the mounting plate 26.

The mounting plate 26 comprises a circular base 40 and a dome portion 42 formed on the circular base. The dome portion 42 has a central aperture 44 with an inner annular groove 46. The securing mechanism 28 comprises the circular base 40 having two spaced apart holes 48. Two mounting screws 50 enter the holes 48 in the circular base 40 and then threaded into the wall 30.

The support member 32 comprises a rectangular bar 52 having a curved inner end 54 to butt against the dome portion 42 of the circular base 40. The rotatably maintaining mechanism 34, as best seen in FIGS. 6, 7 and 8, comprises a shaft 56 extending from the curved inner end 54 of the rectangular bar 52 of the support member 32. The shaft 56 has a split end 58 with a beveled ring 60 thereabout. When the split end 58 of the shaft 56 is inserted within the central aperture 44 in the dome portion 42 on the circular base 40, the beveled ring 60 will enter the inner annular groove 46 to allow the shaft 56 to rotate three hundred and sixty degrees within the central aperture 44.

Figure 10:
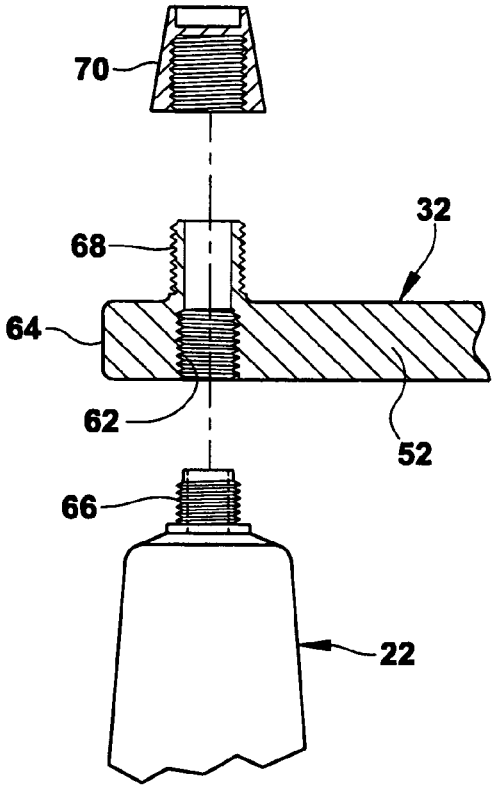
FIG. 10 is a diagrammatic exploded cross sectional view taken along line 10-10 in FIG. 9.
Figure 11:
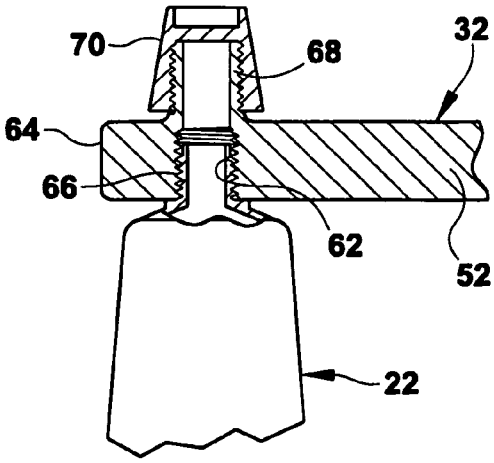
FIG. 11 is a diagrammatic cross sectional view taken along line 11-11 in FIG. 2, showing the toothpaste tube secured to the support member.

The attaching mechanism 36, as best seen in FIGS. 9, 10 and 11, comprises the rectangular bar 52 of the support member 32 having a transverse internally threaded bore 62 near an outer end 64 thereof to receive an externally threaded neck 66 of the toothpaste tube 22 therein. An externally threaded collar 68 is formed on the rectangular bar 52 of the support member 32 directly above and in alignment with the internally threaded bore 62. A cap 70 or a snap cap 71 (see FIG. 3) of the toothpaste tube 22 can be threaded onto the externally threaded collar 68 for storage when the rectangular bar 52 of the support member 32 is rotated with the toothpaste tube 22 down not being used (see FIG. 2) and then rotated with the toothpaste tube 22 up and the cap 70 or snap cap 71 removed, so that the toothpaste tube 22 can be manually squeezed for use (see FIG. 1).

The retaining mechanism 38 comprises at least one spring clip 72 mounted on a bottom portion of the circular base 40 of the mounting plate 26 to releasably grip a handle 74 of the at least one toothbrush 24. The holder 20 further comprises a digital clock 76 mounted within an upper portion of the circular base 40 of the mounting plate 26 to indicate time therefrom.

It will be understood that each of the elements described above, or two or more together, may also find a useful application in other types of constructions differing from the types described above.

While the invention has been illustrated and described as embodiments of a holder for a toothpaste tube and toothbrushes, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A holder for a toothpaste tube and toothbrushes which comprises:

a) a mounting plate;

b) means for securing said mounting plate to a wall;

c) a support member;

d) means for rotatably maintaining said support member perpendicular to said mounting plate;

e) means for attaching the toothpaste tube perpendicular to said support member; and f) means for retaining at least one of the toothbrushes to said mounting plate wherein said mounting plate comprises:

I) a circular base; and

II) a dome portion formed on said circular base, said dome portion having a central aperture with an inner annular groove.

2. The holder as recited in claim 1, wherein said securing means comprises said circular base having two spaced apart holes; adapted for receiving mounting screws which enter said holes in said circular base and then threaded into the wall.

3. The holder as recited in claim 1, wherein said support member comprises a rectangular bar having a curved inner end to butt against said dome portion of said circular base.

4. The holder as recited in claim 3, wherein said rotatably maintaining means comprises a shaft extending from said curved inner end of said rectangular bar of said support member, said shaft having a split end with a beveled ring thereabout, whereby when said split end of said shaft is inserted within said central aperture in said dome portion on said circular base, said beveled ring will enter said inner annular groove to allow said shaft to rotate three hundred and sixty degrees within said central aperture.

5. The holder as recited in claim 4, wherein said attaching means comprises:

a) said rectangular bar of said support member having a transverse internally threaded bore near an outer end thereof to receive an externally threaded neck of the toothpaste tube therein; and b) an externally threaded collar formed on said rectangular bar of said support member directly above and in alignment with said internally threaded bore, whereby a cap/snap cap of the toothpaste tube can be threaded onto said externally threaded collar for storage when said rectangular bar of said support member is rotated with the toothpaste tube down not being used and then rotated with the toothpaste tube up and the cap/snap cap removed, so that the toothpaste tube can be manually squeezed for use.

6. The holder as recited in claim 5, wherein said retaining means comprises at least one spring clip mounted on a bottom portion of said circular base of said mounting plate to releasably grip a handle of the at least one toothbrush.

7. The holder as recited in claim 6, further comprising a clock mounted within an upper portion of said circular base of said mounting plate to indicate time therefrom.

* * * * *